United States Patent [19]

Fisher

[11] 4,010,617

[45] Mar. 8, 1977

[54] COMPOSITE ARCH STRUCTURE

[75] Inventor: Christopher L. Fisher, Winnipeg, Canada

[73] Assignee: Armco Steel Corporation, Middletown, Ohio

[22] Filed: May 19, 1975

[21] Appl. No.: 578,605

[52] U.S. Cl. ..... 61/45 R; 52/169.9; 61/45 C

[51] Int. Cl.² ..... F16L 9/22; E01G 5/06; E21D 9/00

[58] Field of Search ..... 61/45 R, 45 C, 16; 52/573, 169, 168, 167, 396, 274, 298, 346; 404/27, 71

[56] References Cited

UNITED STATES PATENTS

| | | | |
|---|---|---|---|
| 597,281 | 1/1898 | Geisel | 52/87 |
| 969,851 | 9/1910 | Eickershoff | 61/45 C |
| 1,528,034 | 3/1925 | Thielmann | 61/45 C |
| 1,638,473 | 8/1927 | Cochrane | 61/45 R |
| 1,765,200 | 6/1930 | Bullough | 61/45 C X |
| 2,036,490 | 4/1936 | Neilson et al. | 61/45 C |
| 2,298,184 | 10/1942 | Von Rosenberg | 52/167 |
| 2,749,713 | 6/1956 | Paurat | 61/45 C |
| 3,508,406 | 4/1970 | Fisher | 61/45 R X |

FOREIGN PATENTS OR APPLICATIONS

| | | | |
|---|---|---|---|
| 1,359,021 | 3/1964 | France | 61/45 C |
| 74,687 | 2/1949 | Norway | 52/167 |
| 943,658 | 12/1963 | United Kingdom | 61/45 C |
| 943,531 | 12/1963 | United Kingdom | 61/45 C |

*Primary Examiner*—Dennis L. Taylor
*Attorney, Agent, or Firm*—Melville, Strasser, Foster & Hoffman

[57] ABSTRACT

In a composite arch structure of the type comprising an arched liner with compacted fill material or dense soil thereagainst to form a soil arch thereabout, means and a method to permit controlled settling of the liner so as to achieve load relief on the liner and a soil arch with improved load supporting capabilities. A foundation is provided for the liner comprising yielding footer means. The yielding of the footer means is controlled so that the liner settles at a desired rate relative to the adjacent compacted and consolidated fill material when a predetermined load on the liner is exceeded.

23 Claims, 11 Drawing Figures

COMPOSITE ARCH STRUCTURE

BACKGROUND OF THE INVENTION

1. Field of the Invention

The invention relates to a composite arch structure of the type comprising an arched liner and compacted fill material thereagainst to form a soil arch, and more particularly to a method and means for providing controlled settling of the arched liner resulting in an improved soil arch with greater load supporting capabilities.

2. Description of the Prior Art

The teachings of the present invention are applicable to any type of arch wherein load transfer to some form of abutment means is contemplated. For purposes of an exemplary showing, the invention will be described with respect to its application to composite arch structures of the type comprising an arched liner with compacted fill material thereagainst to form a soil arch thereabout. Such structures are used, for example, as highway or railway culverts, bridges, protective underground structures, snow sheds and the like. While the arched liner may be made of any appropriate material including concrete or plastic, again for purposes of an exemplary showing the invention will be described in terms of the use of liners made up of relatively thin, flexible, arcuately curved, corrugated metallic plates. The edges of the arched liner are supported on footers and the arched liner itself, when viewed in end elevation, may have any appropriate curved shape such as a truncated ellipse, parabola, hyperbola or a circle.

U.S. Pat. No. 3,508,406teaches a number of embodiments of composite arch structures of the type to which the present invention is directed. When the arched liner is made of relatively thin, arcuately curved, corrugated metallic plates or the like, it will be understood that the liner will be relatively flexible and will have sufficient strength to permit the liner to be properly installed. However, the strength of the liner is not at all capable of supporting the superimposed load of the completed composite arch structure. The final strength of the structure resides primarily in the compacted soil arch about the liner. When the span of the liner is relatively large, it may be provided with longitudinally extending buttress means affixed to the liner. The buttress means may be performed concrete buttresses or may be poured in place during the construction of the composite arch, as is taught in the above mentioned U.S. Pat. No. 3,508,406. Sand or gravel filled bins similarly affixed to the liner accomplish the same purpose.

Heretofore, footers for the liner of a composite arch of the type contemplated were prepared by first digging a trench for each footer having a width for the size footer desired, based upon the expected load and the supporting characteristics of the soil beneath the footer. The trench for each footer ran the entire length of the structure. Concrete was then poured in each trench to form the desired footers.

If the footers were to extend above the level of the ground, forms were used for those portions of the footers above ground. A number of methods were used to attach the edgemost plates of the arched liner to the footers. One common method entailed the use of L-shaped channels affixed to and extending the length of the concrete footers. The long wall of the L-shaped channel of each footer was provided with holes, so spaced as to align with corresponding holes in the edgemost plates of the arched liner to permit these plates to be bolted to their respective L-shaped channels. Frequently, these bolt holes in the long walls of the L-shaped channels were in the form of horizontal slots so as to permit some leeway in fitting the edgemost liner plates to their respective L-shaped channels. The channels were of such width as to accept the corrugations of the liner plates. The bottom of each channel element carried a plurality of anchoring lugs embedded in the concrete footer prior to the hardening thereof.

The basic cross-sectional configuration of the footers varied with the size and type of structure being built, the angle of entry of the arched liner edges into their respective channels and like considerations. The footers, for example, could constitute an integral part of a concrete slab or roadway extending therebetween.

As will be understood by one skilled in the art, the fill material about the liner will tend to shift downwardly or settle. This settling is the result of a number of different factors. During the placement of the back fill about the liner, compaction will artificially produce a volume change in the fill material by rolling, vibration, tamping and other momentary load applications. With the passage of time, a volume change will occur in the fill material by virtue of consolidation. A static external load will produce a volume change by compression. Finally, shrinkage may produce a volume change in the fill material by virtue of capillary stresses during drying of the fill material. As used herein and in the claims hereafter, the terms "settle" and "settling", as applied to the fill material, should be construed broadly enough to encompass any one, any combination or all of the above noted types of volume change and downward shifting of the fill material.

The present invention is based upon the discovery that if yielding footer means are used, permitting controlled settling or peripheral shortening of the liner, the load upon the liner is relieved and a stronger soil arch with improved load supporting capabilities results. It will further be understood by the skilled worker in the art that controlled settling of the liner will result in a diminishing of the cross-sectional area encompassed by the liner and the bottom of the tunnel defined thereby. In this sense, the settling of the liner results in a peripheral shortening thereof.

While in most such structures the amount of settling falls within a matter of inches or less, the specific amount and the specific rate of settling are not the primary considerations. The primary factor, among many, is the relative rate of settling between the liner and the fill material. The settling of the liner should be so controlled as to be equal to or greater than the settling of the fill material.

SUMMARY OF THE INVENTION

The present invention is directed to a composite arch structure of the type comprising an arched liner with compacted fill material thereagainst to form a soil arch thereabout. Yieldable footer means are provided for the liner. The yielding of the footer means is controlled so that the liner will settle at a rate equal to or greater than the settling of the fill material thereabout.

In a first embodiment, each footer comprises a two-part structure. The first part is an elongated member extending the length of the arched liner and having a longitudinal slot therein. The second part of the footer comprises a shiftable member, again extending the length of the liner. The liner edge is affixed to the second part of the footer which is adapted to be slidably received in the longitudinal slot of the first footer part. Within the slot of the first footer part there is located a compressible material which will permit a slow and controlled movement of the second footer part into the slot.

In another embodiment, the same footer structure is employed. However, an incompressible material is located in the slot. A plurality of holes leading from the slot to the interior of the tunnel defined by the liner are provided either in the first or the second footer part. These holes may be such that the incompressible material will bleed or extrude up through them in a controlled manner. Alternatively, the holes may be so sized as to permit removal of the incompressible material from the slot in a controlled manner by augur means or the like.

In yet another embodiment of the invention, the footer elements are identical to those described with respect to the first and second embodiments, but the incompressible or compressible material is replaced by a distortable member filled with a fluid. The distortable member has one or more outlets extending through holes either in the first or the second footer part to the interior of the tunnel defined by the liner. The one or more outlets are each provided with valve means by which the fluid may be released in a controlled manner.

In another embodiment of the invention, the first footer part comprises a trench-like structure, the inner wall of which is lined with concrete or other suitable material. The remainder of the trench is filled with a yielding material. The edge of the arched liner is affixed to a second footer part or block extending the length thereof. The block is located against the lined wall of the trench and is capable of shifting downwardly along the lined wall through the action of the yielding material.

In yet another embodiment of the invention, the second or movable footer part may have an inverted L-shaped cross-section, the long leg of the L-shaped cross-section being received within the longitudinal slot of the first footer part and the short leg of the L-shaped cross-section adapted to overlie the upper surface of the first footer part. Between the upper surface of the first footer part and the underside of the short leg of the second footer part there is located a block of compressible material. As the block compresses in a predetermined fashion, the second footer part will slid downwardly within the slot of the first footer part.

In another embodiment of the present invention the footer comprises a unitary structure located in a trench filled with incompressible material. The footer may be provided with a plurality of holes passing therethrough and leading to the interior of the tunnel defined by the liner. These holes may be so sized as to permit the incompressible material to bleed or extrude upwardly therethrough in a controlled fashion, or they may be of such dimension as to permit controlled removal of the incompressible material by augur or other appropriate means. Alternatively, the unitary structure could be provided with a void into which the incompressible material could shift.

In a final embodiment of the present invention the footer is a unitary structure to which the edge of the liner is affixed. The footer extends the length of the liner and is located in a trench containing compressible material. As the material compresses, the footer is enabled to sink into the trench.

It is also within the scope of the invention, in association with all of the above described embodiments, to so construct the liner itself as to permit actual, physical peripheral shortening thereof, as will be described hereinafter.

DESCRIPTION OF THE PREFERRED EMBODIMENTS

Figure 1:
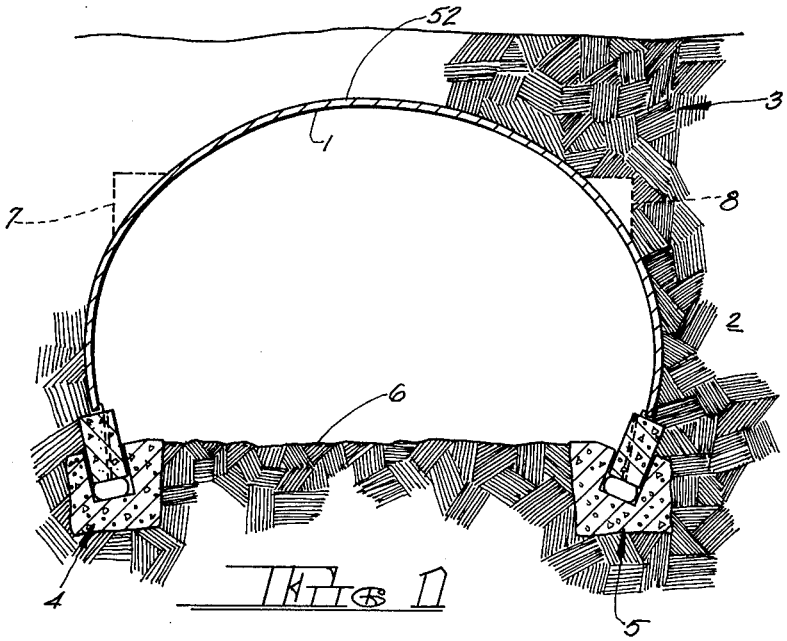
FIG. 1 is a cross-sectional view of an exemplary composite arch structure illustrating one embodiment of the yieldable footers of the present invention.

FIG. 1 illustrates an exemplary composite arch structure comprising an arched liner 1 with compacted fill material 2 thereagainst forming a soil arch generally indicated at 3 thereabout. As indicated above, the liner may be made of any suitable material. In a typical embodiment, the liner 1 is made up of relatively thin, corrugated, steel panels joined together by bolts or other suitable means. The liner is supported by footers generally indicated at 4 and 5.

The initial ground level is indicated at 6. In the usual construction procedure, the footers 4 and 5 are first put in place. The edge panels of the liner are then affixed to their respective footers, the footers running the full length of the liner. When the liner is complete, it will have sufficient strength to be free-standing, but by virtue of the thickness of the panels used and the size of the structure, the liner will generally be flexible and will not have sufficient strength to sustain, in and of itself, the weight of the fill material place thereabout. Careful back filling and compaction of fill material against the liner is then conducted on both sides of the liner with progress at both sides of the liner being substantially the same. It will be understood by one skilled in the art that the strength of the back fill will be added to the liner as work progresses. Upon completion of the back filling and compaction, the soil arch 3 is formed and itself sustains the bulk of the forces thereon. During the construction process, the liner serves primarily as a form for the soil arch. Upon completion of the structure, the arch liner serves primarily simply as a lining for the structure.

When the composite arch structure is relatively large and has a relatively large span, it has been found that back fill and compaction become difficult at or above those points on the sides of the liner where the radial forces acting on the liner form an angle of about 45° or more to the horizontal. Compaction and back fill at or above these points may bring about the risk of distortion or failure of the liner. As a consequence, it has been found advantageous to affix to each side of the liner, at or above those points, longitudinally extending load-spreading buttress means. Such buttress means are indicated in dotted lines at 7 and 8 on either side of the liner 1. Such buttress means are taught in the above mentioned U.S. Pat. No. 3,508,406. The buttress means may take any one of a number of forms. For example, they may be precast concrete elements affixed to the liner. Alternatively, they may comprise concrete members affixed to the liner, having been poured in place during the back filling operation. In yet another form, they may constitute bin-like structures filled with sand or other known consolidated material.

The present invention is based upon the discovery that if the liner 1 is permitted to settle in a controlled fashion (i.e., at a rate equal to or greater than the settling of the fill material), the load pressures above the liner may be directed away from the steel arch to the back fill material itself, which is more capable of sustaining the load pressures. This results in further consolidation and packing of the particles of the back fill material in closer and tighter formation, thereby increasing the strength of the soil arch and its load supporting capabilities. It has been found that the soil arch can be made to sustain 90% or more of the live load, the liner bearing only 10% or less.

Figure 2:
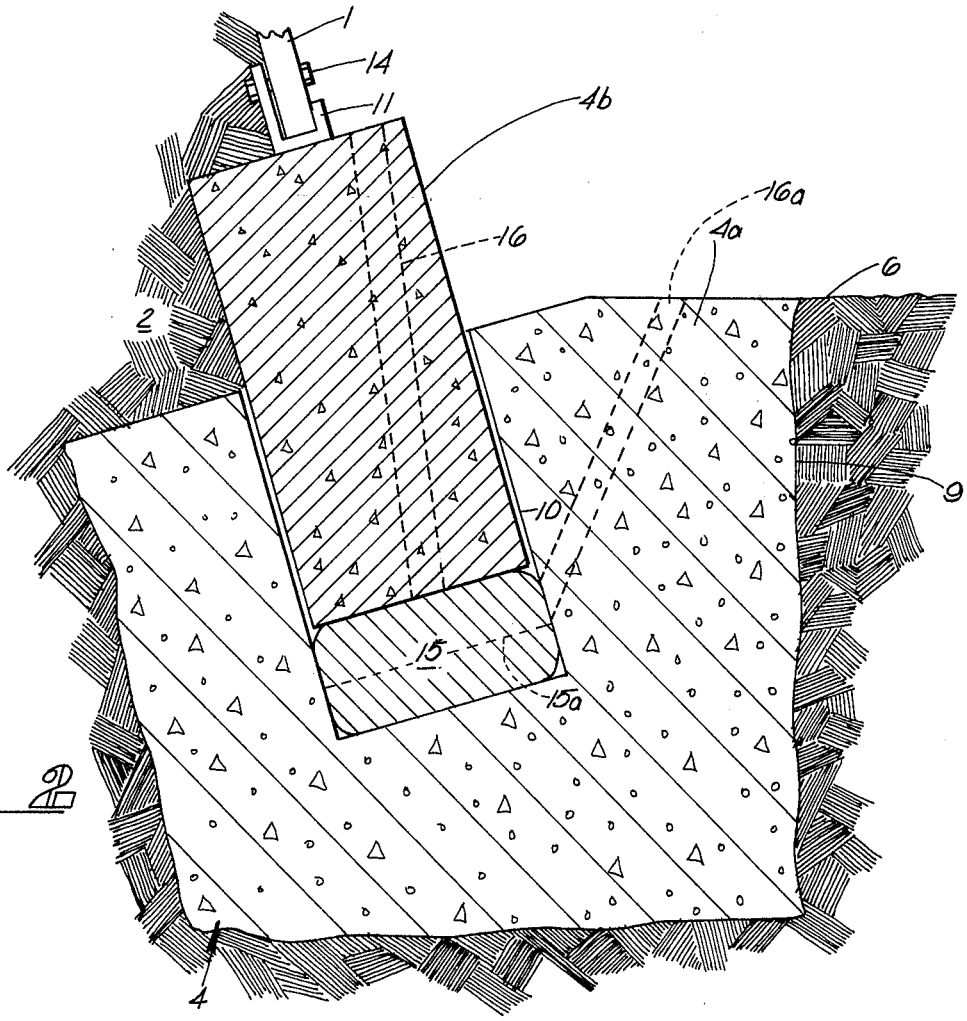
FIG. 2 is a fragmentary cross-sectional elevational view of the left-hand footer of FIG. 1.

It will be understood that the footer 5 is a mirror image of the footer 4 and is otherwise identical. The footer 4 is best shown in FIG. 2. Footer 4 comprises a first footer part 4*a* and a second footer part 4*b*. While the footer part 4*a* may be made of any suitable material and in any appropriate manner, it can readily be poured of concrete in an appropriate size trench 9 at the initial ground level 6 and of a length equal to the length of the liner 1. Through the use of a suitable form or the like, a longitudinally extending notch or slot 10 is provided in the footer part 4*a*, again being of a length equal to the length of the liner 1. The slot 10 should lie at an angle to the horizontal substantially equivalent to the angle formed by the edge of the arched liner 1 to the horizontal.

The second footer part 4*b* extends the length of the liner 1 and may be made of any suitable material including metal wood or the like. As shown in FIG. 2, the part 4*b* constitutes a precast concrete member. The second footer part is so sized as to be received in the slot 10 of the footer part 4*a* with a sliding fit.

Figure 3:
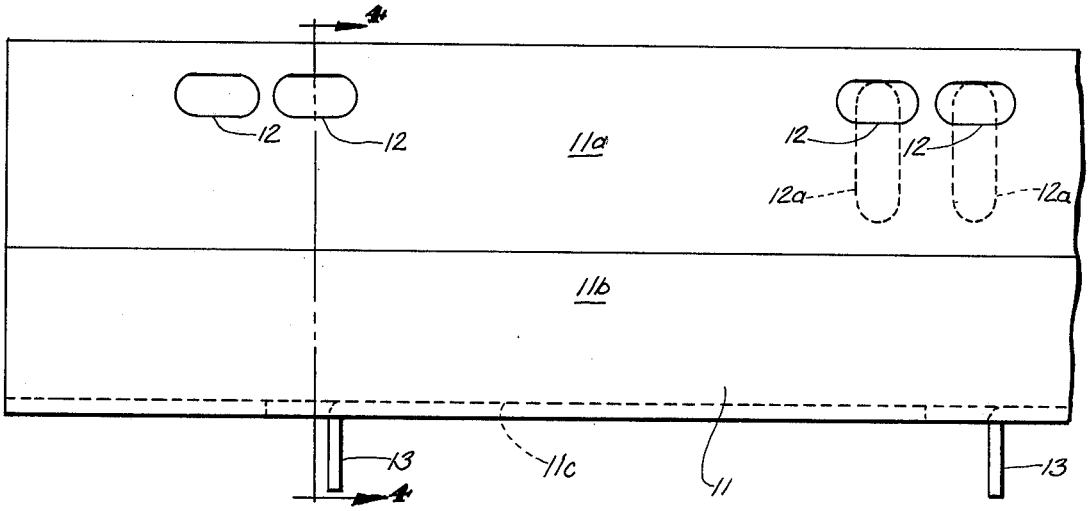
FIG. 3 is a fragmentary, side elevational view of an L-shaped channel by which the arched liner of the composite arch structure is affixed to its footers.
Figure 4:
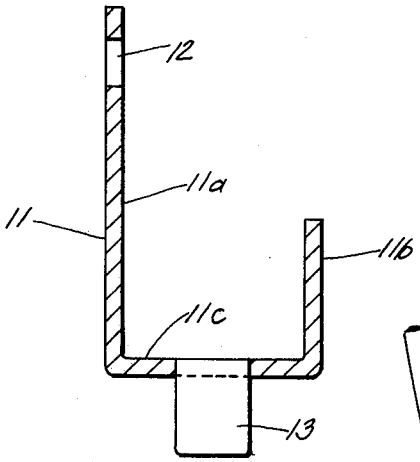
FIG. 4 is a cross-sectional view taken along the section line 4—4 of FIG. 3.
Figure 5:
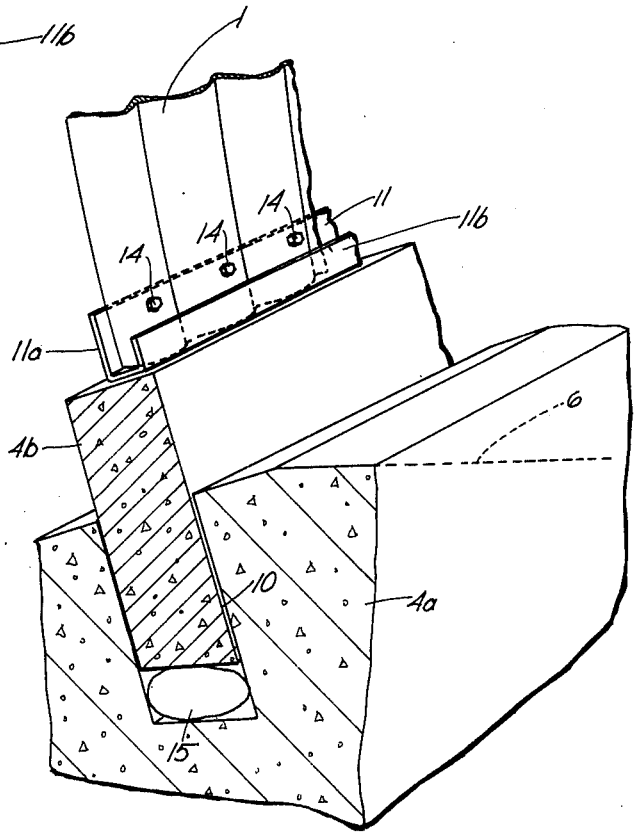
FIG. 5 is a fragmentary perspective view, partly in cross-section, illustrating the one edge of the arched liner affixed to the L-shaped channel of FIG. 3, which, in turn, is affixed to the footer of FIGS. 1 and 2.

The edge of the liner 1 is affixed to the second footer part 4*b* by means of an L-shaped channel 11. The channel 11 is most clearly shown in FIGS. 3 through 5. The channel comprises a tall wall 11*a*, a short wall 11*b* and an intermediate web 11*c*. The tall wall 11*a* is provided with a plurality of perforations in the form of short horizontal slots 12. Finally, the L-shaped channel 13 has a plurality of anchor tabs formed from the web 11c and extending downwardly as at 13. During the formation of the second footer part 4b, the anchor tabs 13 are embedded in the concrete to firmly affix the channel 11 to the footer part 4b. During the assembly of the liner, those plates forming the edge of the liner are located in the L-shaped channel 11 between the tall wall 11*a* and the short wall 11*b* and are bolted to the tall wall. To this end, the liner plates are provided with bolt holes adapted to align with the slots 12. Bolts 14 affix the liner plates to the channel 11, as is shown in FIGS. 2 and 5. It will be evident from FIGS. 4 and 5 that the web 11c of the channel is of such width as to easily accept the corrugations of the panels of liner 1. In this way, the liner edge is firmly affixed to the footer part 4*b*.

Referring to FIGS. 2 and 5, the bottom of the longitudinal slot 10 of footer part 4*a* is provided with a compressible material 15. Preferably, the compressible material runs the full length of the slot 10 and is of approximately uniform depth. As will be described hereinafter, the compressible material 15 should be carefully selected to provide the required settling of the liner. While not so limited, typical compressible materials suitable for this purpose may include wood, air-entrained concrete, a synthetic material with suitable compressibility such as urethane and the like.

As will further be described hereinafter, the footers may be so designed as to initiate settling of the liner at any desired stage as the fill material 2 is caused to settle for any of the reasons enumerated above by appropriate selection of the predetermined limiting load, the exceeding of which will activate the yielding footer means. Thus, the footers could be so designed as to initiate settling of the liner during the initial back filling and top loading of liner 1.

Under most circumstances, however, during the initial back filling and top loading of the liner 1, the forces will not be sufficient to compress the compressible material 15. As the forces exceed the predetermined limiting load, however, the material 15 will compress, causing the liner 1 to settle. Keeping in mind the nature of the back fill material, the size and purpose of the structure and the forces involved, the size of slot 10 and the amount of compressible material with a given compressibility would determine the controlled settling of the liner 1, including the amount and rate thereof.

It would also be within the scope of the invention to provide a compressible element 15 made up of two layers of different material having different compressibilities. This would provide a load actuated system capable of triggering a resistance mechanism. Thus, for example, the initial load actuated settling would take place at a first predetermined rate dependent upon the more easily compressible layer and thereafter at a lesser predetermined rate dependent upon the characteristics of the less compressible layer.

FIG. 2 can also be considered to be an illustration of a second embodiment of the present invention. This embodiment is substantially the same as the previously described embodiment with the exception that the material 15 is incompressible, rather than compressible. The controlled settling of liner 1 is accomplished by controlled removal of the incompressible material 15 from beneath the footer part 4*b*. To this end, the footer part 4b may be provided with a plurality of augur holes, spaced along its length. One such augur hole is illustrated in broken lines at 16 in FIG. 2. The hole 16 is so sized that an augur may be extended therethrough and used to remove the material 15 at a predetermined rate.

Any appropriate incompressible, cohesionless solid may be used. Clay, or a clay-sand mixture, would serve as an appropriate incompressible material.

Alternatively, the footer part 4*b* may be provided with a plurality of holes, so sized as to permit controlled extrusion or bleeding therethrough of the incompressible material 15. Hole 16 in FIG. 2 may also be considered to represent such a bleed hole or extrusion orifice. Valve means (not shown) may be connected to the upper end of hole 16 to further control the bleeding or extrusion of the incompressible material 15. Instead of the holes 16 in footer part 4*b*, similar holes, serving either as bleed or augur holes, could be located in footer part 4a as shown in broken lines at 16*a*.

When the embodiment of FIG. 2 is provided with incompressible material 15, substantially the same factors must be taken into consideration in order to establish the predetermined and desired settling rate for liner 1. The difference here lies in the fact that instead of compressing a material having a known compression characteristic, the incompressible material is removed at a predetermined rate (whether it be by auguring, bleeding, extruding or the like).

Figure 6:
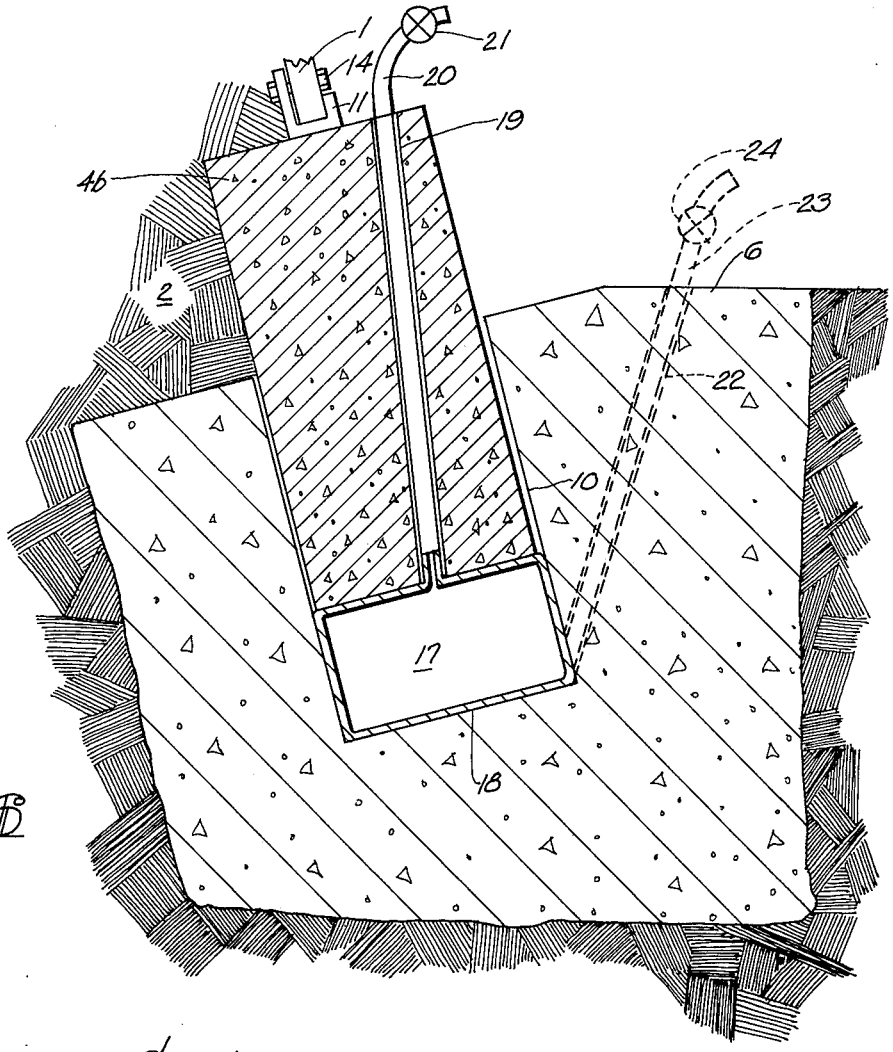
FIG. 6 is a fragmentary cross-sectional view similar to FIG. 2 and illustrating another embodiment of the yieldable footer of the present invention.

FIG. 6 illustrates another embodiment utilizing an incompressible material. The first and second footer parts are substantially identical to those illustrated in FIG. 2 and like parts have been given like index numerals. The primary difference between the embodiment of FIG. 6 and that of FIG. 2 lies in the fact that the embodiment of FIG. 6 utilizes an incompressible material in the form of a fluid located within a flexible, deformable container 18, such as a steel container.

A hole 19 is provided in the second footer part 4*b* to receive a tubular outlet 20 of the container 18. At its uppermost end, extending beyond footer part 4b, an appropriate adjustable valve 21 is provided to permit controlled bleeding of the fluid 17. It will be understood by one skilled in the art that the outlet for container 18 may extend through a hole in footer part 4*a*, rather than footer part 4*b*. This is illustrated in broken lines in FIG. 6 wherein the footer part 4*a* is shown as having a hole 22 extending from the bottom of slot 10. An outlet 23 provided with an adjustable valve 24 is illustrated as being located within the hole 22.

The container 18 may extend the length of the liner and, if desired, may be provided with more than one outlet tube 20 and valve 21. Alternatively, a plurality of shorter containers may be located in slot 10, either in end-to-end abutting relationship or spaced from each other.

It will be understood by one skilled in the art that the valve or valves 21 will be so adjusted (manually or mechanically) as to release the fluid 17 in a controlled manner to provide the desired controlled settling of liner 1. It will further be understood that if footer part 4*b* were appropriately sealed in slot 10, no container 18 would be required, the hole 19 in footer part 4*b* or the hole 22 in footer part 4a could be, themselves, provided with appropriate valve means.

Figure 7:
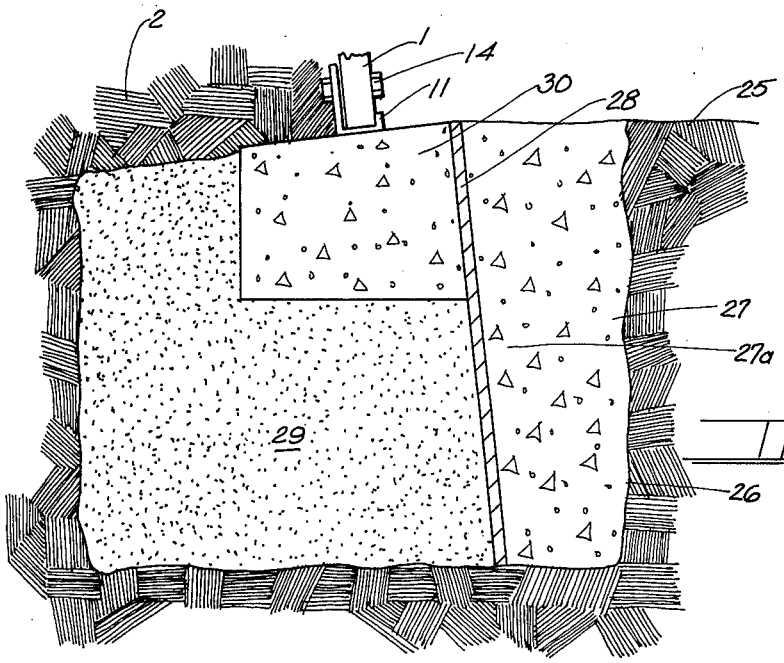
FIG. 7 is a fragmentary, cross-sectional view illustrating yet another embodiment of the yieldable footer of the present invention.

Another embodiment of the present invention is illustrated in FIG. 7. The initial ground level is shown at 25. In this embodiment, the first footer part comprises a trench 26, the inside vertical wall of which is lined with any appropriate material such as the concrete lining 27. The concrete lining 27 presents a smooth, planar face 27*a* preferably oriented at an angle substantially parallel to the edge portion of liner 1 affixed to channel 11. The face 27*a* may be covered with a fiber layer, plywood, polyethylene material or the like, the purpose of which will be described hereinafter. The remainder of the trench 26 is filled with a known yieldable material 29 such as silt or the like which would compress at a rate faster than the surrounding soil. The trench 26 will extend the length of liner 1.

The second footer part comprises a block 30 of any appropriate material. The block 30 also extends the length of the liner 1 and may, for example, comprise a preformed concrete member. The liner 1 is affixed to footer part 30 in any appropriate way, including the use of L-shaped channel 11 and bolts 14, as described with respect to FIG. 2.

In operation, the compressible material 27 and the size of the trench portion containing it are chosen in the light of substantially the same factors outlined with respect to the embodiment of FIG. 2. The same is true for the size of footer part 30. It will be understood that the compacted back fill material 2 will tend to urge the second footer part 30 against the face 27*a* lining wall 27. During the controlled settling permitted by the compressible material 29, the second footer part 30 will shift downwardly along the lining wall 27. The fiber or plywood or synthetic layer 26 will assure proper movement of the second footer part 30 along the lining wall and will prevent bonding or undue friction therebetween. It will be understood that the layer 28 may be affixed either to the surface 27*a* of lining wall 27 or the adjacent surface of second footer part 30. In either event, the layer 28 preferably covers the entire surface to which it is affixed. From the above description, it will be understood that the embodiment of FIG. 7 will provide a predetermined and controlled settling of liner 1.

In the embodiment of FIG. 7 an incompressible material 29 may also be used, so long as the material is capable of plastic flow. In such an instance, as footer part 30 settles, the incompressible material will flow thereabove.

Figure 8:
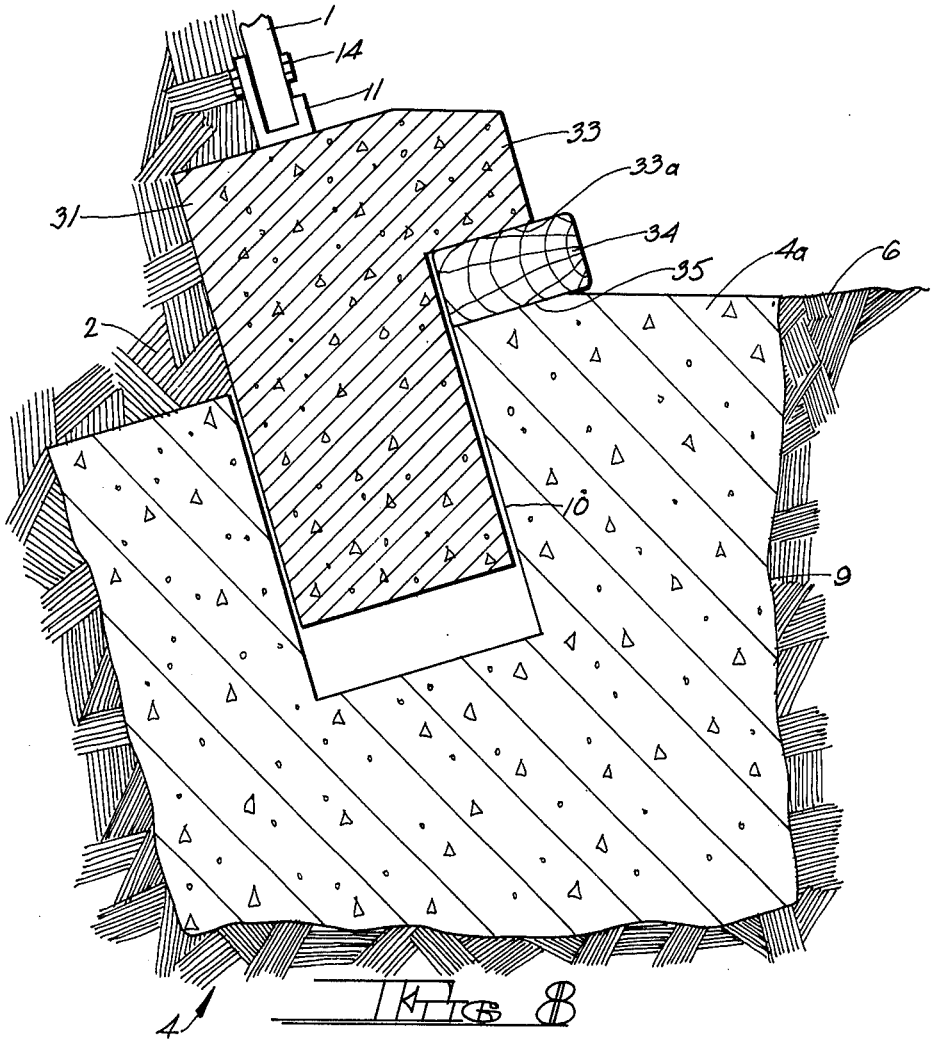
FIG. 8 is a fragmentary, cross-sectional view similar to FIG. 2 and illustrating another embodiment of the yieldable footer of the present invention employing a modified movable footer part.

Another embodiment of the present invention is illustrated in FIG. 8. In this figure, the first footer part is identical to that of FIG. 2 and like parts have been given like index numerals. The second footer part 31 is similar to second footer part 4*b* of FIG. 2 with the exception that it has a lateral extension 33, the bottom surface of which is shown at 33*a*. The liner 1 may be affixed to the second footer part in any appropriate way. For purposes of an exemplary showing, it is illustrated as being attached to the second footer part in the same manner described with respect to FIG. 2 and like parts have been given like index numerals.

As in the case of the embodiment of FIG. 2, footer part 4a extends the length of the liner 1, as does the slot 10 therein. Similarly, footer part 31 and its extension 33 run the length of liner 1. In this embodiment, a block of compressible material of known characteristics is shown at 34 located between the undersurface 33*a* of extension 33 and the top surface portion 35 of footer part 4*a*. The block 34 may be made of any of the compressible materials listed above and for purposes of an exemplary showing is illustrated as being a wooden block. The block 34 may run the length of the extension 33. Alternatively, a series of blocks may be used in end-to-end relationship. The series of blocks may have their ends abutting, or they may be spaced from each other. The greater the forces to be sustained, the more nearly continuous the block or blocks should be. It will be evident that as the block 34 compresses, the second footer part 31 will shift downwardly witin slot 10, resulting in the settling of liner 1. The appropriate selection of block 34 with respect to its compression characteristics, cross-sectional size, and the like will produce the desired controlled settling.

Figure 9:
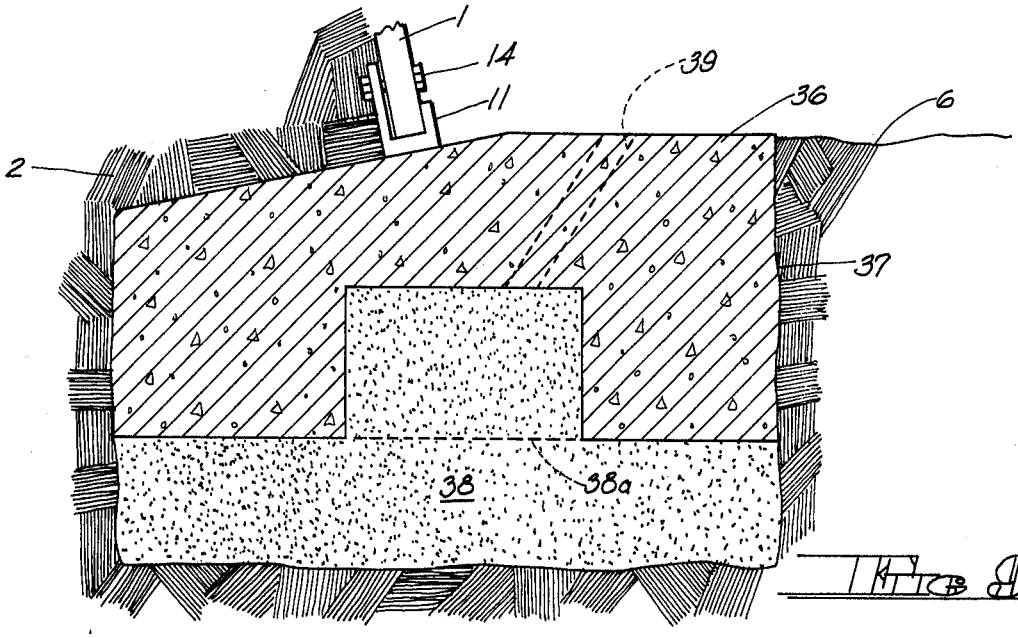
FIG. 9 is a fragmentary, cross-sectional view illustrating yet another embodiment of the yieldable footer of the present invention wherein the footer comprises a unitary structure mounted in a trench containing incompressible material.
Figure 11:
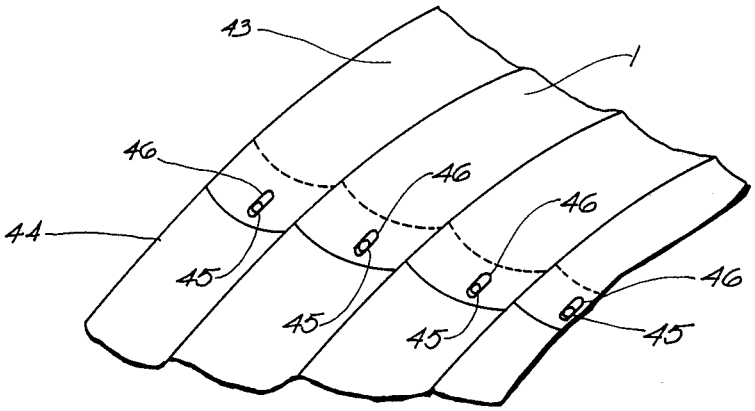
FIG. 11 is a fragmentary perspective view illustrating two plates of a flexible liner bolted together, one plate having slots to receive the bolts to enable the plates to shift slightly with respect to each other to reduce their peripheral dimensions.

FIG. 9 illustrates an embodiment wherein the footer comprises a single footer element 36 and a trench 37, the footer element 36 being intended to settle in a controlled fashion within trench 37. The trench 37 is formed at the initial ground level and is of a length equal to the length of the liner 1. The unitary footer element 36 is adapted to be received within the trench 37 and extends the length of liner 1. The liner 1 may be affixed to the footer element 36 in any appropriate manner. Again it is illustrated as being attached to the footer in the same manner taught with respect to FIG. 2 and like parts have been given like index numerals.

The cross-sectional configuration and size of footer element 36 will depend upon the size and nature of the structure being built, the nature of the fill material 2 and like considerations. The upper surface of the footer element will be shaped in accordance with the angularity of that portion of liner 1 affixed to it. While the factor element 36 may have a rectangular or substantially rectangular cross-section, for purposes of an exemplary showing it is illustrated as having an inverted U-shaped cross-section.

Within the trench 37 and beneath footer element 36 there is located an incompressible material 38. The material 38 may be made up of any of the incompressible materials listed above and again the amount and nature of the material 38 will depend upon the settling characteristics desired for the liner 1 and can readily be determined by one skilled in the art. The controlled settling is achieved in substantially the same way taught with respect to FIG. 2 when the material 15 is incompressible. To this end, a plurality of holes 39 may be provided in footer element 36 to enable controlled removal of the material 38 by augur means or the like. Alternatively, the holes 39 could constitute bleed or extrusion holes in the same manner described with respect to FIG. 2. On the other hand, the incompressible material could be a fluid rather than a cohensionless solid and could be confined in a container (not shown) in the manner taught with respect to FIG. 6, the container having outlet means by which the fluid could be expelled in a controlled fashion.

It will be understood that if the settling of footer element 36 is brought about by bleeding or extrusion of the incompressible material, the hole 39 could be so angled as to lead the bleed or extruded material to the outside of liner 1, rather than to the inside thereof, as illustrated. Where the incompressible material 38 is capable of plastic flow, it could be placed in trench 37 to the level indicated by broken line 38*a*, leaving the center portion of inverted U-shaped footer element 36 empty. Settling will occur, under these circumstances, when the material 38 flows upwardly into the empty center portion of the footer element 36. Hole 39 may still be provided for further settling, if desired.

Figure 10:
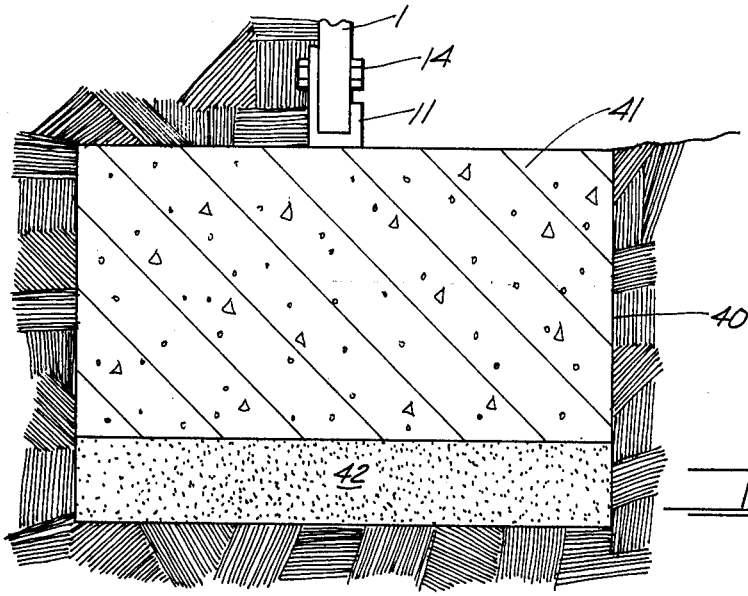
FIG. 10 is a fragmentary, cross-sectional view illustrating a one-piece footer mounted in a trench having compressible material therein.

The embodiment of FIG. 10 is related to that of FIG. 9, differing primarily in that a compressible material is used, rather than an incompressible material. Again, the entire footer is intended to settle. In a manner similar to that described with respect to FIG. 9, a trench 40 is formed the length of liner 1. A footer element 41 is located in the trench and the area below footer element 41 is filled with a compressible material. For purposes of an exemplary showing, the footer element is illustrated, in this instance, as having a substantially rectangular cross-section. Again, footer element 41 will extend the length of liner 1. Simply for purposes of illustration, the edge of liner 1 is illustrated as being oriented perpendicular to the upper surface of footer 41. Attachment of the liner to the footer again may be accomplished in any appropriate manner and again L-shaped channel 11 and bolts 14 are illustrated. The compressible material may be any of those mentioned with respect to FIG. 2 and the material along with the size of the trench 40, the size of the footer 41 and the amount of material 42 will be chosen to provide the desired settling characteristics for liner 1.

In all of the embodiments thus far described, the liner should settle at a rate equal to or faster than the settling of the fill material. The embodiments of the present invention fall within two categories: those utilizing compressible material and those utilizing incompressible material. When compressible material is utilized, its compression characteristics and the amount of material used will be selected on the basis of the nature of the fill material and its settling rate, the nature of the structure contemplated and the amount of settling of the liner required. When incompressible material is used, the considerations are substantially the same. In this instance, however, the amount of incompressible material and the rate of its removal are important factors.

The various embodiments of the present invention permit an additional predetermined adjustment, i.e. at what point the settling of the liner should begin. For example, the materials may be so chosen and provided in such amounts that the settling of the liner begins when the load level thereon approaches the strength limits of the liner. Alternatively, the system may be designed to begin settling of the liner when the load level reaches one-half (or some other fraction) of the ultimate strength limit of the liner. These determinations may be readily made by one skilled in the art and depend upon such factors as soil characteristics, strength of the liner, compaction techniques and the like.

The settling of the liner results in an effective reduction of the peripheral dimensions of the liner, as indicated above. It is within the scope of the invention to provide in addition to the yieldable footers of the present invention means to bring about an actual peripheral shortening of the liner itself. This may be accomplished in a number of ways. For example, the holes 12 in the L-shaped member 11 of FIG. 3 may be vertically slotted as shown at 12*a* in broken lines in FIG. 3. The edgemost plates of the tunnel liner may be so affixed to the tall wall 11a as to be spaced upwardly from the web 11c so that they can shift downwardly into abutment with the web 11c to shorten the peripheral dimension of the liner. Alternatively, or in addition, the panels of the liner may be made of materials which will slide together. FIG. 12 illustrates a pair of liner panels 43 and 44 joined together at their lapped edges by bolts 45. One of the lapped panel edges (in the illustration the edge of panel 43) may be provided with slots 46 through which the bolts 45 extend. The panels will be arranged in the manner illustrated in FIG. 12. It will be understood, however, that upon the placement of a load on liner 1, panel 43 may shift downwardly with respect to panel 44 for a distance equivalent to the length of the slots 46. All or selected ones of the panels of liner 1 may be provided with such slots to produce an actual peripheral shortening of the liner.

Modifications may be made in the invention without departing from the spirit of it.

The embodiments of the invention in which an exclusive property or privilege is claimed are defined as follows:

1. In a composite arch structure of the type comprising a liner with compacted fill material thereagainst and thereabout to form a soil arch thereabout, a foundation for said liner comprising yieldable footer means, and means to control the amount and rate of yielding of said footer means whereby said liner will settle at a rate at least equal to the rate of settling of said fill material thereabout.

2. The structure claimed in claim 1 wherein said liner is an arched liner having two longitudinal edges, each of said longitudinal liner edges being affixed to a yieldable footer means, each of said yieldable footer means comprising a first footer element and a second footer element, the adjacent one of said longitudinal liner edges being affixed to said second footer element, said second footer element, said second footer element being in part at least receivable within said first footer element and being capable of settling therein.

3. The structure claimed in claim 1 including means to shorten the peripheral dimensions of said arched liner.

4. The structure claimed in claim 2 including means to shorten the peripheral dimension of said arched liner.

5. The structure claimed in claim 2 wherein said first footer element comprises an elongated member extending the length of said liner longitudinal edge and having a top surface with a longitudinal slot therein, said second footer element comprising an elongated member extending the length of said liner longitudinal edge, a portion at least of said second footer element being receivable within said longitudinal slot of said first footer element with a telescoping fit and being configured to settle within said longitudinal slot.

6. The structure claimed in claim 2 wherein said first footer element comprises an elongated trench extending the length of said liner longitudinal edge, said second footer element comprising an elongated member extending the length of said liner longitudinal edge, said second footer element being located in said trench and being capable of settling therein.

7. The structure claimed in claim 4 including upstanding means affixed to said second footer part, said upstanding means having a plurality of vertical slots therein, said adjacent one of said liner edges having a plurality of corresponding holes therein, said last mentioned liner edge being affixed to said upstanding means and in spaced relationship to said second footer means by fastening means passing through corresponding ones of said liner holes and said slots in said upstanding means whereby said slots permit relative movement of said last mentioned liner edge toward said second footer means to shorten the peripheral dimension of said arched liner.

8. The structure claimed in claim 4 wherein said arched liner is made up of a plurality of arcuate panels, those adjacent panel edges extending longitudinally of said liner being lapped, one of those adjacent edges having holes therein, the other of said adjacent edges having corresponding slots therein, said adjacent panel edges being joined together by fastening means extending through said corresponding holes and slots whereby said slots permit relative movement of said joined panel edges to shorten the peripheral dimension of said arched liner.

9. The structure claimed in claim 5 including a layer of compressible material of known compressibility within said elongated slot in said first footer element, said material being compressible by said second footer element whereby said material controls said amount and rate of yielding of said footer.

10. The structure claimed in claim 5 including superposed layers of first and second compressible materials within said elongated slot in said first footer element, said first and second materials being compressible by said second footer element, said first and second materials having known compressibilities, said first material being more easily compressible than said second material, whereby said first material initially controls said amount and rate of yielding of said footer and said second material thereafter controls said amount and rate of yielding of said footer.

11. The structure claimed in claim 5 including a layer of incompressible material within said elongated slot in said first footer element, said portion at least of said second footer element within said slot resting upon and being supported by said incompressible material and means for removing said incompressible material from said slot at a predetermined rate whereby to control said amount and rate of yielding of said footer.

12. The structure claimed in claim 5 wherein said second footer element is of inverted L-shape configuration, the long leg of said inverted L-shaped second footer element comprising said portion receivable within said longitudinal slot of said first footer element with a telescoping fit, the short leg of said inverted L-shaped second footer element overlying said top surface of said first footer element adjacent said slot therein, at least one block of material of known compressibility being located between said top surface of said first footer element and said short leg of said second footer element, said block of material being compressible by said short leg whereby to control said amount and rate of yielding of said footer.

13. The structure claimed in claim 6 wherein said trench has a pair of longitudinally extending side walls one located exteriorly of said liner and the other located interiorly of said liner, means lining said interior side wall and presenting a smooth planar face substantially parallel to said longitudinal liner edge portion affixed to said second footer element, said second footer element having a longitudinal surface parallel to and in abutment with said lining face, said trench being filled with compressible material of known compressibility initially maintaining said second footer element in abutment with the upper part of said lining face, said compressible material being compressible by said second footer part whereby to permit settling of said second footer element downwardly along said lining face and whereby to control said amount and rate of yielding of said footer.

14. The structure claimed in claim 6 wherein said trench has a pair of longitudinally extending side walls one located exteriorly of said liner and the other located interiorly of said liner, means lining said interior side wall and presenting a smooth planar face substantially parallel to said longitudinal liner edge portion affixed to said second footer element, said second footer element having a longitudinal surface parallel to and in abutment with said lining face, said trench being filled with incompressible material initially maintaining said second footer element in abutment with the upper part of said lining face, said incompressible material being capable of plastic flow at a known rate whereby to permit settling of said second footer element downwardly along said lining face and whereby to control said amount and rate of yielding of said footer.

15. The structure claimed in claim 6 wherein said trench is partially filled with incompressible material, said second footer element being supported in said trench by said incompressible material and means for removing said incompressible material from said trench at a predetermined rate whereby to control said amount and rate of yielding of said footer.

16. The structure claimed in claim 6 wherein said trench is partially filled with incompressible material, said second footer element being of an inverted U-shaped cross sectional configuration, the legs of said inverted U-shaped second footer element being supported in said trench by said incompressible material, said incompressible material being capable of plastic flow at a known rate whereby said incompressible material will flow upwardly between said legs of said inverted U-shaped second footer element controlling said amount and rate of yielding of said footer.

17. The structure claimed in claim 6 wherein said trench is partially filled with a compressible material of known compressibility, said second footer element being supported in said trench upon said compressible material, said compressible material being compressible by said second footer element whereby to control said amount and rate of yielding of said footer.

18. The structure claimed in claim 11 including at least one auger hole passing through one of said first and second footer elements from said slot though the top of said one of said footer elements at a point within said liner whereby said incompressible material may be removed from said slot at a predetermined rate by auger means.

19. The structure claimed in claim 11 including a passage passing through one of said first and second footer elements from said slot through the top of said one of said footer elements, said incompressible material being capable of plastic flow through said passage at a predetermined rate whereby to control said amount and rate of yielding of said footer.

20. The structure claimed in claim 11 including a passage passing through one of said first and second footer elements from said slot through the top of said one of said footer elements, said incompressible material being a fluid, means to prevent leakage of said fluid between said first and second footer elements, means permitting escape of said fluid from said slot through said passage at a predetermined rate whereby to control said amount and rate of yielding of said footer.

21. The structure claimed in claim 15 including at least one auger hole passing through said second footer element from said trench through the top of said second footer element at a point within said liner whereby said incompressible material may be removed from said trench at a predetermined rate by auger means.

22. The structure claimed in claim 15 including a passage passing through said second footer element from said trench through the top of said second footer element, said incompressible material being capable of plastic flow through said passage at a predetermined rate whereby to control said amount and rate of yielding of said footer.

23. The structure claimed in claim 15 including a passage passing through said second footer element from said trench through the top of said second footer element, said incompressible material being a fluid, means to prevent leakage of said fluid between said trench and said second footer element, means permitting escape of said fluid from said trench through said passge at a predetermined rate whereby to control said amount and rate of yielding of said footer.

* * * * *